US012123615B2

(12) United States Patent
Wang et al.

(10) Patent No.: US 12,123,615 B2
(45) Date of Patent: Oct. 22, 2024

(54) WATER BAFFLING STRUCTURE AND AIR CONDITIONER WITH WATER BAFFLING STRUCTURE

(71) Applicants: GREE ELECTRIC APPLIANCES (WUHAN) CO., LTD, Wuhan (CN); GREE ELECTRIC APPLIANCES, INC. OF ZHUHAI, Zhuhai (CN)

(72) Inventors: Chunjie Wang, Zhuhai (CN); Ruishui Guo, Zhuhai (CN); Fuan Wang, Zhuhai (CN)

(73) Assignees: GREE ELECTRIC APPLIANCES (WUHAN) CO., LTD., Wuhan (CN); GREE ELECTRIC APPLIANCES, INC. OF ZHUHAI, Zhuhai (CN)

( * ) Notice: Subject to any disclaimer, the term of this patent is extended or adjusted under 35 U.S.C. 154(b) by 153 days.

(21) Appl. No.: 16/648,604

(22) PCT Filed: Aug. 31, 2018

(86) PCT No.: PCT/CN2018/103493
§ 371 (c)(1),
(2) Date: Mar. 18, 2020

(87) PCT Pub. No.: WO2019/095789
PCT Pub. Date: May 23, 2019

(65) Prior Publication Data

US 2021/0364188 A1 Nov. 25, 2021

(30) Foreign Application Priority Data

Nov. 20, 2017 (CN) ..... 201711171149.6

(51) Int. Cl.
*F24F 13/22* (2006.01)

(52) U.S. Cl.
CPC ..... *F24F 13/22* (2013.01)

(58) Field of Classification Search
CPC ..... F24F 13/30; F24F 13/222; F24F 13/224; F24F 13/20; F24F 13/00; F24F 13/22; F25D 21/14
See application file for complete search history.

(56) References Cited

U.S. PATENT DOCUMENTS 5,904,053 A 5/1999 Polk et al.
2016/0209055 A1* 7/2016 Gedcke ..... F24F 13/20
(Continued)

FOREIGN PATENT DOCUMENTS

CN 202328706 U 7/2012
CN 103307716 A 9/2013
(Continued)

OTHER PUBLICATIONS

International Search Report for corresponding International Application No. PCT/CN2018/103493, mailed Nov. 14, 2018, 3 pages.

*Primary Examiner* — Tavia Sullens
(74) *Attorney, Agent, or Firm* — Armstrong Teasdale LLP

(57) ABSTRACT

Provided is a water baffling structure, for keeping out condensate water generated on a small elbow (31) of an evaporator (30). The water baffling structure includes a water baffle body (10), the water baffle body (10) is mounted on a motor seat (20), and at least part of the water baffle body (10) covers the small elbow (31). An air conditioner with the water baffling structure is further provided.

10 Claims, 5 Drawing Sheets

(56) References Cited

U.S. PATENT DOCUMENTS

| | | | | |
|---|---|---|---|---|
| 2016/0334155 | A1* | 11/2016 | Sjogren | F24F 13/22 |
| 2019/0003732 | A1* | 1/2019 | Seo | F24F 13/30 |

FOREIGN PATENT DOCUMENTS

| | | | |
|---|---|---|---|
| CN | 203375566 | U | 1/2014 |
| CN | 104089390 | A | 10/2014 |
| CN | 203868514 | U | 10/2014 |
| CN | 204063501 | U | 12/2014 |
| CN | 204678600 | U | 9/2015 |
| CN | 105065788 | A | 11/2015 |
| CN | 205351714 | A | 6/2016 |
| CN | 205980232 | U | 2/2017 |
| CN | 207501419 | U | 6/2018 |
| CN | 207501420 | U | 6/2018 |
| EP | 0507267 | A3 | 2/1993 |

* cited by examiner

WATER BAFFLING STRUCTURE AND AIR CONDITIONER WITH WATER BAFFLING STRUCTURE

CROSS-REFERENCE TO RELATED APPLICATIONS

The present disclosure is a national stage application of International Patent Application No. PCT/CN2018/103493, filed on Aug. 31, 2018, which claims priority to Chinese Patent Application No. 201711171149, filed on Nov. 20, 2017, and entitled "Water Baffling Structure and Air Conditioner with Water Baffling Structure," the contents of which are hereby incorporated by reference in their entirety.

TECHNICAL FIELD

The present disclosure relates to a field of air conditioners, and in particular to a water baffling structure and an air conditioner with the water baffling structure.

BACKGROUND

For an air conditioner known to the inventors, a water baffling film clamped on a small elbow of an evaporator is a plastic sheet, with a simple structure. A buckle of the water baffling film is folded downward first before assembling, and assembled onto the evaporator of the air conditioner, as to play a role of water baffling.

However, the buckle may rebound to some extent when the water baffling film is folded, in this way the inventors realized that there are the following defects after assembling.

1. There is a gap between the water baffling film and an edge plate of the evaporator, and condensate water may appear at a place nearby the gap when the air conditioner runs.

2. Virtual clamping may easily appear during assembling of the buckle, thereby causing a failure of the water baffling film to baffle the water.

Therefore, it is a pressing problem to be solved that the water baffling film known to the inventors is insecure to baffle the water because the buckle is rebounded.

SUMMARY

Some embodiments of the present disclosure provide a water baffling structure and an air conditioner with the water baffling structure, as to solve the problem that a mounting mode of the water baffling structure known to the inventors is unstable.

Some embodiments of the present disclosure provide a water baffling structure. The water baffling structure is configured to keep out condensate water generated by a small elbow of an evaporator. The water baffling structure includes a water baffle body, the water baffle body is mounted on a motor seat, and at least part of the water baffle body covers the small elbow.

In an exemplary embodiment, the at least part of the water baffle body is disposed on a connecting pipe on the motor seat in a pressing manner.

In an exemplary embodiment, the water baffle body includes a first plate body, the first plate body is connected with the motor seat, and at least part of the first plate body is disposed on the connecting pipe in a pressing manner.

In an exemplary embodiment, the water baffle body further includes a second plate body, the second plate body is connected with the first plate body, and at least part of the second plate body covers the small elbow.

In an exemplary embodiment, the first plate body and the second plate body are integrally moulded.

In an exemplary embodiment, a pipe passage allowing the connecting pipe to pass through is formed between the water baffle body and the motor seat.

In an exemplary embodiment, the water baffle body is provided with at least one wiring passage configured to place a wire.

In an exemplary embodiment, all wiring passages are connected.

In an exemplary embodiment, the wiring passage is a rectangular groove.

In an exemplary embodiment, a passage wall of the wiring passage is provided with a wiring buckle, and the wiring buckle is configured to clamp the wire tightly.

In an exemplary embodiment, there are a plurality of wiring buckles, and the plurality of wiring buckles are disposed at intervals.

Some embodiments of the present disclosure provide an air conditioner, the air conditioner includes the motor seat, the evaporator, a connecting pipe and the abovementioned water baffling structure. At least part of the connecting pipe is disposed on the motor seat, the water baffling structure is mounted on the motor seat.

In an exemplary embodiment, a water baffle body is connected with the motor seat in a clamping manner, or in a bonding manner or through a fastener.

In an exemplary embodiment, the water baffle body and the motor seat are integrally moulded.

In an exemplary embodiment, the water baffle body is provided with a first buckle, the motor seat is provided with a first clamping groove cooperating with the first buckle, and the first buckle is clamped in the first clamping groove.

In an exemplary embodiment, the water baffle body is provided with a second buckle, the motor seat is provided with a second clamping groove cooperating with the second buckle, and the second buckle is clamped in the second clamping groove.

In an exemplary embodiment, the water baffle body is provided with a inserting plate, the motor seat is provided with a slot cooperating with the inserting plate, and the inserting plate is inserted into the slot.

In an exemplary embodiment, there are a plurality of inserting plates, and the plurality of inserting plates are provided at intervals. There are a plurality of slots, and each of the plurality of inserting plates is inserted into a corresponding slot in the plurality of inserting plates.

In an exemplary embodiment, the water baffling structure is provided with a fastening hole, and the motor seat is provided with an inserting hole. The air conditioner further includes a fastener, and the fastener is disposed inside the inserting hole and the fastening hole in a penetrating manner.

Through mounting the water baffle body on the motor seat, the water baffling structure of the present disclosure ensures that the at least part of the water baffle body steadily covers the small elbow. During mounting, the water baffle body is mounted on the motor seat. Meanwhile, in order to keep out the condensate water generated by the small elbow of the evaporator, the at least part of the water baffle body covers the small elbow of the evaporator. In this way, the condensate water generated by the small elbow of the evaporator flows into a water tank through the water baffle body. Through mounting the water baffle body on the motor seat, the water baffling structure of the present disclosure ensures that the at least part of the water baffle body steadily covers the small elbow, in this way the problem that the mounting mode of the water baffling structure known to the inventors is unstable is solved.

BRIEF DESCRIPTION OF THE DRAWINGS

The accompanying drawings described herein are used to provide a further understanding of the present disclosure, and constitute a part of the present application, and the embodiments of the present disclosure and the description thereof are used to explain the present disclosure, but do not constitute improper limitations to the present disclosure. In the drawings.

Herein, the abovementioned drawings may include the following reference numbers:

10, Water baffle body; 11, First buckle; 12, Second buckle; 13, Inserting plate; 14, Fastening hole; 15. Wiring passage; 151, Wiring buckle; 16, First plate body; 17, Second plate body; 20, Motor seat; 21, First clamping groove; 22, Second clamping groove; 23, Slot; 24, Inserting hole; 30, Evaporator; 31, Small elbow; 40, Connecting pipe; 50, Pipe passage.

DETAILED DESCRIPTION OF THE EMBODIMENTS

It is to be noted that embodiments in the application and features in the embodiments may be combined with each other without conflict. The present disclosure will be described below in detail with reference to drawings and in combination with the embodiments.

Some embodiments of the present disclosure provide a water baffling structure. Through referring to FIG. 1-FIG. 7, the water baffling structure is configured to keep out condensate water generated on a small elbow 31 of an evaporator 30. The water baffling structure includes a water baffle body 10, the water baffle body 10 is mounted on a motor seat 20, and at least part of the water baffle body 10 covers the small elbow 31.

Through mounting the water baffle body 10 on the motor seat 20, the water baffling structure in some embodiments of the present disclosure ensures that the at least part of the water baffle body 10 steadily covers the small elbow 31. In some embodiments, the water baffle body 10 is mounted on the motor seat 20. Meanwhile, in order to keep out the condensate water generated by the small elbow 31 of the evaporator 30, the at least part of the water baffle body 10 covers the small elbow 31 of the evaporator 30. In this way, the condensate water generated by the small elbow 31 of the evaporator 30 flows into a water tank through the water baffle body 10. Through mounting the water baffle body 10 on the motor seat 20, the water baffling structure of some embodiments ensures that the at least part of the water baffle body 10 steadily covers the small elbow 31. In this way, the problem that a mounting mode of the water baffling structure known to the inventors is unstable is solved.

Figure 1:
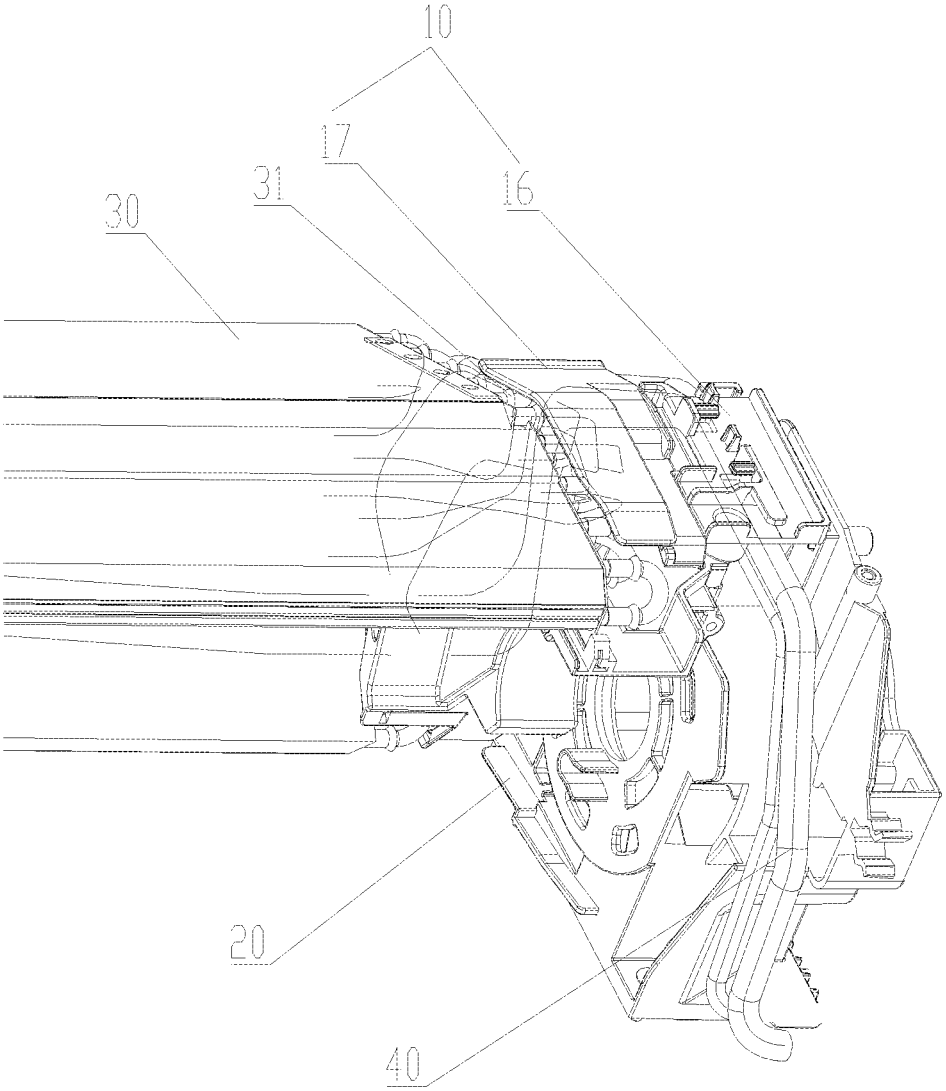
FIG. 1 is a schematic diagram of a first mounting structure of a water baffling structure according to the present disclosure.
Figure 2:
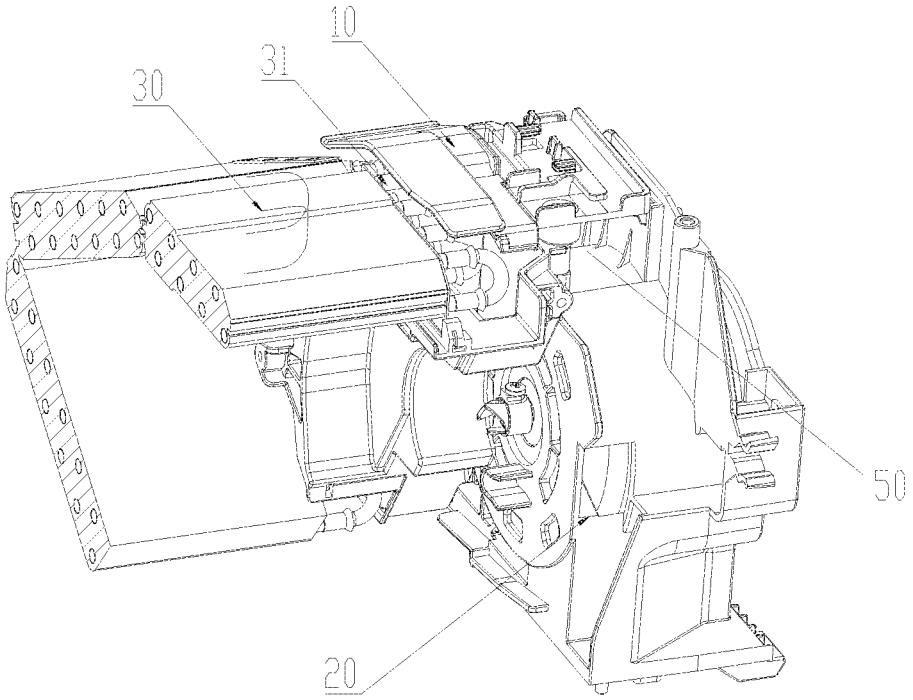
FIG. 2 is a schematic diagram of a second mounting structure of a water baffling structure according to the present disclosure.

In order to cooperate with a mounting position of a connecting pipe 40 mounted on the motor seat 20, as shown in FIG. 1, the at least part of the water baffle body 10 is disposed on the connecting pipe 40 on the motor seat 20 in a pressing manner.

In some embodiments, in view that the connecting pipe 40 passes through the motor seat 20, therefore, in order to cooperate with the mounting position of the connecting pipe 40 mounted on the motor seat 20 and ensure mounting stability of the connecting pipe 40, the at least part of the water baffle body 10 is disposed on the connecting pipe 40 in the pressing manner. In this way, the connecting pipe 40 is ensured to be disposed on the motor seat 20 steadily.

In some embodiments, as shown in FIG. 1, the water baffle body 10 includes a first plate body 16, the first plate body 16 is connected with the motor seat 20, and at least part of the first plate body 16 is disposed on the connecting pipe 40 in a pressing manner.

In some embodiments, the water baffle body 10 is provided with the first plate body 16, herein, the first plate body 16 is connected with the motor seat 20. The at least part of the first plate body 16 is disposed on the connecting pipe 40 in the pressing manner, in this way the connecting pipe 40 is ensured to be disposed on the motor seat 20 steadily.

In some embodiments, the water baffle body 10 further includes a second plate body 17 connected with the first plate body 16, and at least part of the second plate body 17 covers the small elbow 31.

In the embodiment, the water baffle body 10 is provided with the second plate body 17, herein, the second plate body 17 is connected with the first plate body 16. The at least part of the second plate body 17 covers the small elbow 31, in this way the condensate water generated on the small elbow 31 of the evaporator 30 is ensured to flow into the water tank through the water baffle body 10.

In view of processing convenience, in some embodiments, the first plate body 16 and the second plate body 17 are integrally moulded.

In some embodiments, in order to configure the at least part of the water baffle body 10 on the connecting pipe 40 in a pressing manner, wherein the connecting pipe 40 is disposed on the motor seat 20, a pipe passage 50 allowing the connecting pipe 40 to pass through is formed between the water baffle body 10 and the motor seat 20.

Figure 4:
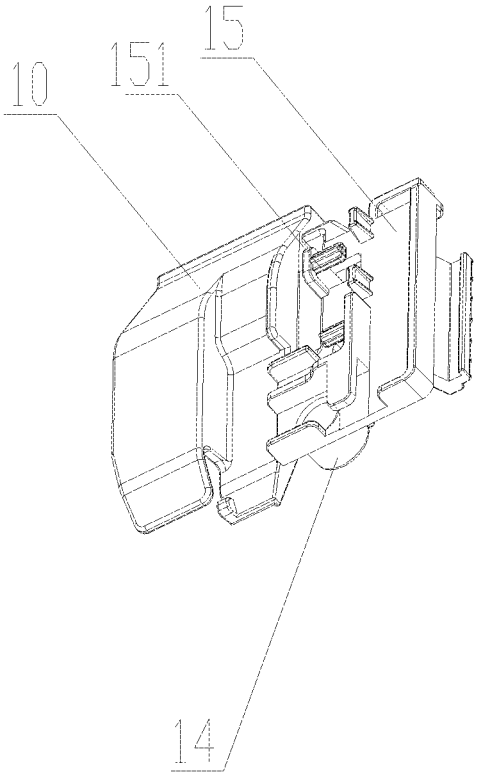
FIG. 4 is a structure diagram of a second angle of view of a water baffling structure according to the present disclosure.
Figure 6:
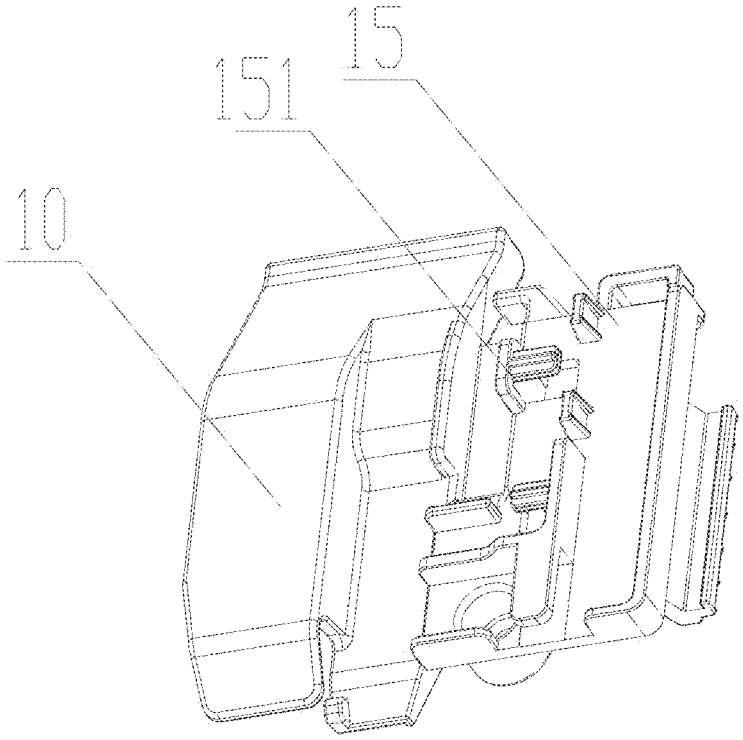
FIG. 6 is a structure diagram of a fourth angle of view of a water baffling structure according to the present disclosure.

In view of the water baffle body 10 is disposed on the motor seat 20, in some embodiments, in order to ensure that a wire is arranged exactly, as shown in FIG. 4 and FIG. 6, the water baffle body 10 is provided with at least one wiring passage 15 used for placing the wire.

In the embodiments, the water baffle body 10 is provided with the at least one wiring passage 15 used for placing the wire, in this way the wire to be used is ensured to be configured on the wiring passage 15 during using the water baffle. Furthermore, exactly use of the wire is ensured, and an existing structure is effectively utilized.

In view of specific direction and specific configuration of the wire, in some embodiments, all wiring passages 15 are connected.

In allusion to a specific structure of the wiring passage 15, in some embodiments, the wiring passage 15 is a rectangular groove.

In some embodiments, each wiring passage 15 is the rectangular groove, and all rectangular grooves are interconnected. In this way, exact configuration of the wire is ensured.

In order to ensure configuration stability of the wiring passage 15, as shown in FIG. 6, a passage wall of the wiring passage 15 is provided with a wiring buckle 151, and the wiring buckle 151 is configured to clamp the wire tightly.

In some embodiments, the passage wall of the wiring passage 15 is provided with the wiring buckle 151, in this way the wire configured on the wiring passage 15 is clamped on the wiring buckle 151 tightly. Accordingly, stable configuration of the wire is ensured, without detachment and other phenomena.

In order to ensure clamping reliability of the wire, there are a plurality of wiring buckles 151, and the plurality of wiring buckles 151 are disposed at intervals.

In some embodiments, the plurality of wiring buckles 151 are provided, wherein, the plurality of wiring buckles 151 are disposed at intervals. In this way, the wire is clamped on the wiring passage 15 steadily through the wiring buckles 151 disposed at intervals.

Some embodiments of the present disclosure provide an air conditioner, wherein the air conditioner includes a motor seat 20, an evaporator 30, a connecting pipe 40 and a water baffling structure. As shown in FIG. 1, at least part of the connecting pipe 40 is disposed on the motor seat 20, the water baffling structure is mounted on the motor seat 20, and the water baffling structure is the abovementioned water baffling structure.

In order to achieve connection of a water baffle body 10 and the motor seat 20, in some embodiments, the water baffle body 10 is connected with the motor seat 20 in a clamping manner, or in a bonding manner or through a fastener.

In some embodiments, the water baffle body 10 and the motor seat 20 are integrally moulded. The water baffle body 10 and the motor seat 20 are integrally moulded, in this way an overall processing efficiency is improved.

In some embodiments, the water baffle body 10 is connected with the motor seat 20 in the clamping manner. The water baffle body 10 is connected with the motor seat 20 in the clamping manner, in this way the water baffle body 10 is replaced conveniently.

In some embodiments, the water baffle body 10 is directly connected with the motor seat 20 in the bonding manner. The water baffle body 10 is directly connected with the motor seat 20 in the bonding manner, in this way mounting stability of the water baffle body 10 is ensured.

In some embodiments, the water baffle body 10 is connected with the motor seat 20 through a fastener. The water baffle body 10 is mounted on the motor seat 20 through the fastener, in this way mounting stability is ensured, and mounting and demounting is easily achieved.

Figure 3:
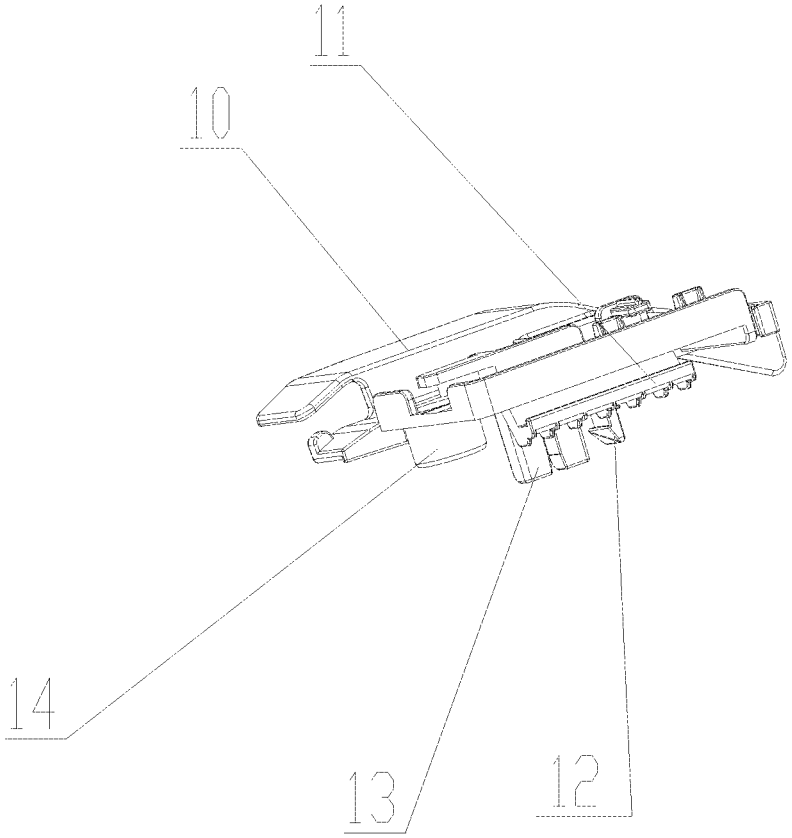
FIG. 3 is a structure diagram of a first angle of view of a water baffling structure according to the present disclosure.
Figure 7:
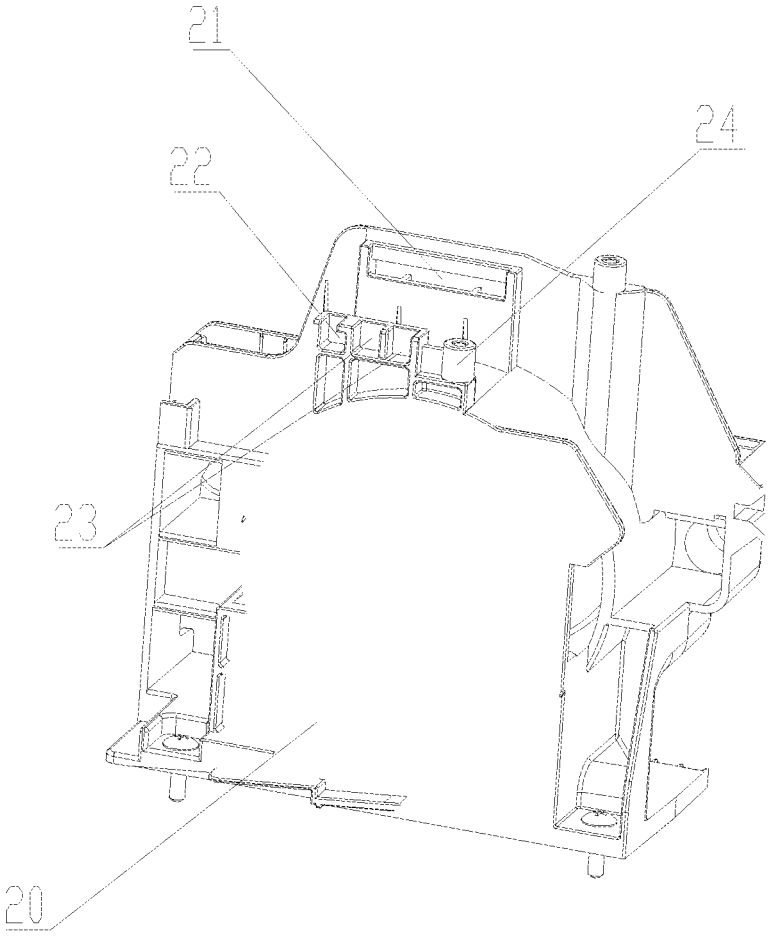
FIG. 7 is a structure diagram of a motor seat of an air conditioner according to the present disclosure.

In order to achieve clamping connection of the water baffle body 10 and the motor seat 20, as shown in FIG. 3 and FIG. 7, the water baffle body 10 is provided with a first buckle 11, the motor seat 20 is provided with a first clamping groove 21 cooperating with the first buckle 11, and the first buckle 11 is clamped inside the first clamping groove 21.

In some embodiments, the water baffle body 10 is provided with the first buckle 11, and the motor seat 20 is provided with the first clamping groove 21 cooperating with the first buckle 11. During mounting the water baffle body 10, the first buckle 11 is clamped inside the first clamping groove 21, in this way clamping connection of the water baffle body 10 and the motor seat 20 is achieved.

In some embodiments, a hook of the first buckle 11 faces a side departing from the motor seat 20. During a mounting process, the first buckle 11 is disposed inside the first clamping groove 21 in a clamping manner, in this way the clamping connection of the water baffle body 10 and the motor seat 20 is achieved.

Figure 5:
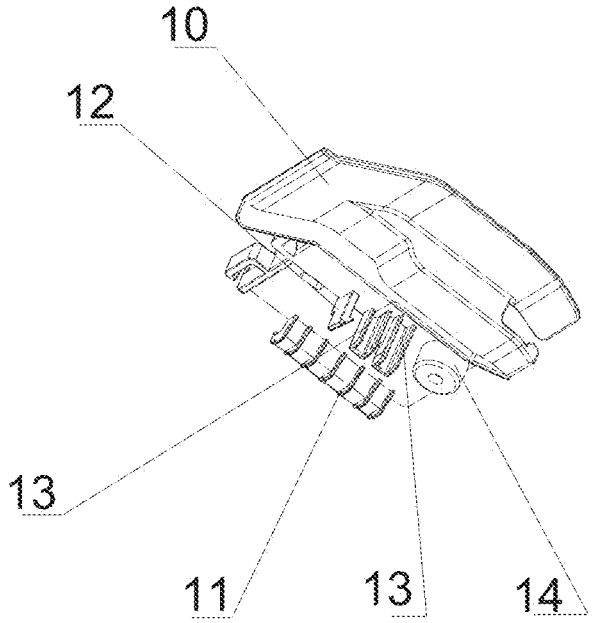
FIG. 5 is a structure diagram of a third angle of view of a water baffling structure according to the present disclosure.

In order to ensure stable clamping connection of the water baffle body 10 and the motor seat 20, as shown in FIG. 5 and FIG. 7, the water baffle body 10 is provided with a second buckle 12, the motor seat 20 is provided with a second clamping groove 22 cooperating with the second buckle 12, and the second buckle 12 is clamped inside the second clamping groove 22.

In some embodiments, the water baffle body 10 is provided with the second buckle 12, and the motor seat 20 is provided with the second clamping groove 22 cooperating with the second buckle 12. During mounting the water baffle body 10, the second buckle 12 is clamped inside the second clamping groove 22, in this way the stable clamping connection of the water baffle body 10 and the motor seat 20 is achieved.

In some embodiments, an extension direction of a hook of the second buckle 12 is vertical to that of the first buckle 11. During a mounting processing, the first buckle 11 is clamped inside the first clamping groove 21, and the second buckle 12 is clamped inside the second clamping groove 22, in this way the stable clamping connection of the water baffle body 10 and the motor seat 20 is achieved.

In order to ensure convenient mounting of the water baffle body 10 and the motor seat 20, in some embodiments, as shown in FIG. 5 and FIG. 7, the water baffle body 10 is provided with a inserting plate 13, the motor seat 20 is provided with a slot 23 cooperating with the inserting plate 13, and the inserting plate 13 is inserted into the slot 23.

In some embodiments, the water baffle body 10 is provided with the inserting plate 13, and the motor seat 20 is provided with the slot 23 cooperating with the inserting plate 13. During mounting the water baffle body 10, the inserting plate 13 is inserted into the slot 23, in this way pretargeting of the water baffle body 10 and the motor seat 20 is achieved. Then, the first buckle 11 is clamped inside the first clamping groove 21, and the second buckle 12 is clamped in the second clamping groove 22, in this way the stable clamping connection of the water baffle body 10 and the motor seat 20 is achieved.

In order to ensure stable inserting stability of the water baffle body 10 and the motor seat 20, in some embodiments, there are a plurality of inserting plates 13, the plurality of inserting plates 13 are disposed at intervals, there are a plurality of slots 23, and each inserting plate 13 is inserted into a corresponding slot 23.

In some embodiments, the plurality of inserting plates 13 are configured, herein, the multiple inserting plates 13 are disposed at intervals. Correspondingly, there are a plurality of slots 23, and the plurality of inserting plates 23 are disposed at intervals. During a mounting process, each inserting plate 13 is inserted into the corresponding slot 23.

In view of that clamping connection is loose during use, as shown in FIG. 5 and FIG. 7, the water baffling structure is provided with a fastening hole 14, the motor seat 20 is provided with an inserting hole 24. The air conditioner further includes a fastener, and the fastener is disposed inside the inserting hole 24 and the fastening hole 14 in a penetrating manner.

In some embodiments, the water baffling structure is provided with the fastening hole 14, and the motor seat 20 is provided with the inserting hole 24. During a specific mounting process, the fastener is disposed inside the inserting hole 24 and the fastening hole 14 in the penetrating manner, in this way the stable connection of the water baffle body 10 and the motor seat 20 is ensured.

The water baffling structure of the air conditioner of some embodiments of the present disclosure substitutes a plastic flaky water baffling film known to the inventors, thereby saving a mould of opening and manufacturing a plastic water baffle, and accordingly saving cost of a whole machine. When the air conditioner is exactly mounted, condensate water is produced at a small elbow 31 of the evaporator 30. The water baffling structure is to keep out the produced condensate water, in this way the condensate water flows into a water tank on a bottom shell along the water baffling structure and accordingly be discharged outdoors through a drain pipe.

In some embodiments, a second plate body 17 for water baffling and a first plate body 16 for a pressure pipe are integrally moulded.

In order to facilitate connection of the water baffle body 10 with the motor seat 20, in some embodiments, the water baffle body 10 is provided with the first buckle 11, the motor seat 20 is provided with the first clamping groove 21 cooperating with the first buckle 11, and the first buckle 11 is clamped inside the first clamping groove 21.

In some embodiments, the water baffle body 10 is provided with the second buckle 12, the motor seat 20 is provided with the second clamping groove 22 cooperating with the second buckle 12, and the second buckle 12 is clamped inside the second clamping groove 22.

In some embodiments, the water baffle body 10 is provided with the inserting plate 13, the motor seat 20 is provided with the slot 23 cooperating with the inserting plate 13, and the inserting plate 13 is inserted into the slot 23.

The water baffle structure is provided with the fastening hole 14, and the motor seat 20 is provided with the inserting hole 24. The air conditioner further includes the fastener, the fastener is disposed inside the inserting hole 24 and the fastening hole 14 in the penetrating manner.

The water baffling structure of the air conditioner of the present disclosure has a function of integration. Beside water baffling, the water baffling structure is integrated with a function of wiring as well. The plurality of wiring buckles 151 are disposed on the water baffling structure, for fixing a circuit of various air conditioner loads. Meanwhile, the water baffling structure is integrated with a function of the pressing pipe as well. An internal and external connecting pipe of the air conditioner is disposed over the motor seat 20. The connecting pipe 40 for an internal and external machine is restrained and limited through cooperation of the water baffle body 10 and the motor seat 20, as to prevent an internal part from damage due to shaking of the connecting pipe 40.

From the abovementioned description, the abovementioned embodiments of the present disclosure achieve the following technical effects.

Through mounting the water baffle body 10 on the motor seat 20, the water baffling structure of some embodiments ensures that the at least part of the water baffle body 10 steadily covers the small elbow 31. During the specific mounting, the water baffle body 10 is mounted on the motor seat 20. Meanwhile, in order to keep out the condensate water generated by the small elbow 31 of the evaporator 30, the at least part of the water baffle body 10 covers the small elbow 31 of the evaporator 30, in this way the condensate water generated by the small elbow 31 of the evaporator 30 flows into the water tank through the water baffle body 10.

Through mounting the water baffle body 10 on the motor seat 20, the water baffling structure of the present disclosure ensures that the at least part of the water baffle body 10 steadily covers the small elbow 31, in this way the problem that the mounting mode of the water baffling structure known to the inventors is unstable is solved.

The above is only some embodiments of the present disclosure and not intended to limit the scope of protection of the present disclosure. For those skilled in the art, the present disclosure may have various modifications and variations. Any modifications, equivalent replacements, improvements and the like made within the spirit and principle of the present disclosure shall fall within the scope of protection of the present disclosure.

What is claimed is:

1. A water baffling structure, wherein, the water baffling structure is configured to keep out condensate water generated on an elbow of an evaporator; the water baffling structure comprises:

a water baffle body, the water baffle body being mounted on a motor seat, and at least part of the water baffle body covering the elbow;

the water baffle body is provided with at least one wiring passage configured to place a wire;

a passage wall of the at least one wiring passage is provided with a wiring buckle, and the wiring buckle is configured to clamp the wire;

the water baffle body comprises:

a first plate body, the first plate body being connected with the motor seat, and at least part of the first plate body being disposed on a connecting pipe on the motor seat in a pressing manner;

the water baffle body further comprises:

a second plate body connected with the first plate body, and at least part of the second plate body keeping out the elbow;

a pipe passage allowing the connecting pipe to pass through is formed between the water baffle body and the motor seat;

the pipe passage and the wiring passages are separated up and down by the first plate body; the water baffle body is provided with at least one inserting plate.

2. The water baffling structure as claimed in claim 1, wherein, the first plate body and the second plate body are integrally moulded.

3. The water baffling structure as claimed in claim 1, wherein, the at least one wiring passage is a rectangular groove.

4. An air conditioner, comprising a water baffling structure, a motor seat, and an evaporator, wherein, the water baffling structure is configured to keep out condensate water generated on an elbow of the evaporator; the water baffling structure comprises:

a water baffle body, the water baffle body being mounted on the motor seat, and at least part of the water baffle body covering the elbow;

the water baffle body is provided with at least one wiring passage configured to place a wire; a passage wall of the at least one wiring passage is provided with a wiring buckle, and the wiring buckle is configured to clamp the wire;

the water baffle body comprises:

a first plate body, the first plate body being connected with the motor seat, and at least part of the first plate body being disposed on a connecting pipe on the motor seat in a pressing manner;

the water baffle body further comprises:

a second plate body connected with the first plate body, and at least part of the second plate body keeping out the elbow;

a pipe passage allowing the connecting pipe to pass through is formed between the water baffle body and the motor seat;

the pipe passage and the wiring passages are separated up and down by the first plate body; the water baffle body is provided with at least one inserting plate.

5. The air conditioner as claimed in claim 4, wherein, the water baffle body and the motor seat are integrally moulded.

6. The air conditioner as claimed in claim 4, wherein, the water baffle body is provided with a first buckle, the motor seat is provided with a first clamping groove cooperating with the first buckle, and the first buckle is clamped in the first clamping groove.

7. The air conditioner as claimed in claim 6, wherein, the water baffle body is provided with a second buckle, the motor seat is provided with a second clamping groove cooperating with the second buckle, and the second buckle is clamped in the second clamping groove.

8. The air conditioner as claimed in claim 4, wherein, the motor seat is provided with at least one slot cooperating with the at least one inserting plate, and the at least one inserting plate is inserted into the at least one slot correspondingly.

9. The air conditioner as claimed in claim 8, wherein, there are a plurality of the at least one inserting plate, the plurality of the at least one inserting plate are provided at intervals, there are a plurality of slots, and each of the plurality of the at least one inserting plate is inserted into a corresponding slot in the plurality of the at least one inserting plate.

10. The air conditioner as claimed in claim 4, wherein, the water baffling structure is provided with a fastening hole, and the motor seat is provided with an inserting hole; and the air conditioner further comprises a fastener, and the fastener is disposed in the inserting hole and the fastening hole in a penetrating manner.

* * * * *